United States Patent [19]

Werth

[11] Patent Number: 4,808,128

[45] **Date of Patent: * Feb. 28, 1989**

[54] ELECTRICAL CONNECTOR ASSEMBLY HAVING MEANS FOR EMI SHIELDING

[75] Inventor: Dee A. Werth, Bainbridge, N.Y.

[73] Assignee: Amphenol Corporation, Wallingford, Conn.

[ * ] Notice: The portion of the term of this patent subsequent to Jul. 30, 2002 has been disclaimed.

[21] Appl. No.: 595,761

[22] Filed: Apr. 2, 1984

[51] Int. Cl.[4] ..... H01R 13/648

[52] U.S. Cl. ..... 439/610; 29/857

[58] Field of Search ..... 339/143 R, 177 R, 177 E, 339/276 R, 89 C, 90 C; 29/828, 857, 861; 439/607–610, 578–585, 320–323, 98

[56] References Cited

U.S. PATENT DOCUMENTS

| | | | |
|---|---|---|---|
| 2,762,025 | 9/1956 | Melcher | 339/143 |
| 2,958,750 | 11/1960 | Lebens | 200/133 |
| 3,099,506 | 7/1963 | Tuchel | 339/143 |
| 3,171,706 | 3/1965 | Daniels | 339/143 |
| 3,281,756 | 10/1966 | OP'Keefe | 339/89 |
| 3,336,566 | 8/1967 | Barker | 339/143 |
| 3,372,364 | 3/1968 | O'Keefe et al. | 339/177 R |
| 3,408,610 | 10/1968 | Clarkston | 339/8 |
| 3,448,430 | 6/1969 | Kelly | 339/143 |
| 3,659,251 | 4/1972 | Fish | 339/143 |
| 3,944,317 | 3/1976 | Oberdiear | 339/143 |
| 3,990,765 | 11/1976 | Hill | 339/177 |
| 4,008,943 | 2/1977 | Flatt | 339/111 |
| 4,126,372 | 11/1978 | Hashimoto | 339/177 |
| 4,243,290 | 1/1981 | Williams | 339/143 |
| 4,248,492 | 2/1981 | Snyder | 339/89 |
| 4,296,986 | 10/1981 | Herrmann | 339/89 |
| 4,330,166 | 5/1982 | Cooper | 339/143 |

*Primary Examiner*—Gary F. Paumen

*Attorney, Agent, or Firm*—Bacon & Thomas

[57] ABSTRACT

A cylindrical sleeve (66) of electrically conductive, plastically deformable, material completes an electrical circuit path between the braid (46) of a cable (40) terminated to a back shell (30), the braid connected electrically to a ferrule (56), and the sleeve having a forward sleeve portion extending from an annular groove (62) of the ferrule and plastically deformed about the toothed end face (34) of the back shell (30) so as to axially overlap and completely cover the teeth and form a 360° electrically conductive seal about the back shell at a location inwardly of the valleys (36) forming the teeth.

5 Claims, 1 Drawing Sheet

ELECTRICAL CONNECTOR ASSEMBLY HAVING MEANS FOR EMI SHIELDING

This invention relates to an electrical connector assembly having means for shielding the assembly from electro-magnetic interference (EMI).

In recent years a need has developed that electrical connector assemblies provide effective shielding against EMI to signal-carrying conductors and, in certain military applications, to withstand severe EMI conditions caused by or generated by electro-magnetic pulses (EMP). To protect the signal-carrying conductors from external EMI effects and the surrounding area from EMI leakage, both shielded cable and internal ground straps have been used. Electrical connectors satisfying U.S. military standards (e.g., MIL-C-38999, MIL-C-26482, etc.) utilize an electrically conductive shell having external thread on its back shell for threadably connecting with internal thread of an accessory boot for supporting the cable to the shell and a continuous plurality of aftward extending V-shaped teeth around its end face which match with accessory teeth for nonrotatably locking the two together However, it has been found that electro-magnetic and radio frequency signals can enter or leave an otherwise shielded plug and receptacle assembly through the connected threads and through slight mismatch between the locking teeth. Hence, the importance of maintaining a continuous 360° electrically conductive shield around the cable connection at the rearward end portion of the connector assembly is now recognized.

Accordingly, one object of the present invention is to provide an electrical connector designed to meet EMI shielding criteria while continuing to satisfy presently established electrical and mechanical performance specifications. Another object of the present invention is provision of an EMI shielding arrangement which provides a continuous 360° seal of electrically conductive material between the back shell and the cable braid around the termination of the cable to the shell. Yet another object is provision of an electrically conductive sleeve which is plastically deformed around the transverse end face of the back shell. Still another object is to provide a continuous 360° electrically conductive seal around the aftwardly extending locking teeth of the back shell and forwardly of a locus of points defining the valleys of the teeth to assure a complete electrical circuit path between the back shell and the cable braid shield.

In furtherance of these and other objects, the electrical connector assembly of the present invention comprises an electrically conductive shell of the type having a mating front portion, a generally cylindrical rear portion or back shell having a transverse end face, an electrical contact carried in the shell for mating, means including an accessory boot of electrically conductive material for connecting the cable to the back shell, means for shielding the shell against electromagnetic interference, a coaxial-type cable having a conductive braid shield encircling a center conductor passing through the accessory boot and terminated to the contact.

In accord with the present invention, shield means are provided for assuring a continuous 360° electrically conductive seal around the back shell to protectively shield the signal-carrying conductors against external electro-magnetic interference and the area surrounding the back shell from EMI leakage. The shield means are comprised of a ferrule of electrically conductive material in electrical circuit relation to the cable braid, and a cylindrical sleeve of electrically conductive material being connected to the ferrule and having a forward sleeve portion plastically deformed about the end face of the back shell to complete a continuous electrical circuit path therewith. The accessory boot is connected to the back shell by a retaining nut rotatably mounted to the ferrule, the ferrule having an annular groove to receive a rearward sleeve portion of the cylindrical sleeve, the plastically deformed forward sleeve portion extending longitudinally forward from the end face of the back shell to provide a continuous 360° electrically conductive seal therearound.

In the situation where V-shaped teeth extend aftwardly from the transverse end face, the electrically conductive seal covers the teeth and the seal extends to a shell location forwardly of the valleys of the teeth formed around the back shell.

One way of carrying out the invention is described in detail below with reference to the drawings which illustrate specific embodiments of this invention, in which.

Figures 1, 2, 3, 4, 5:
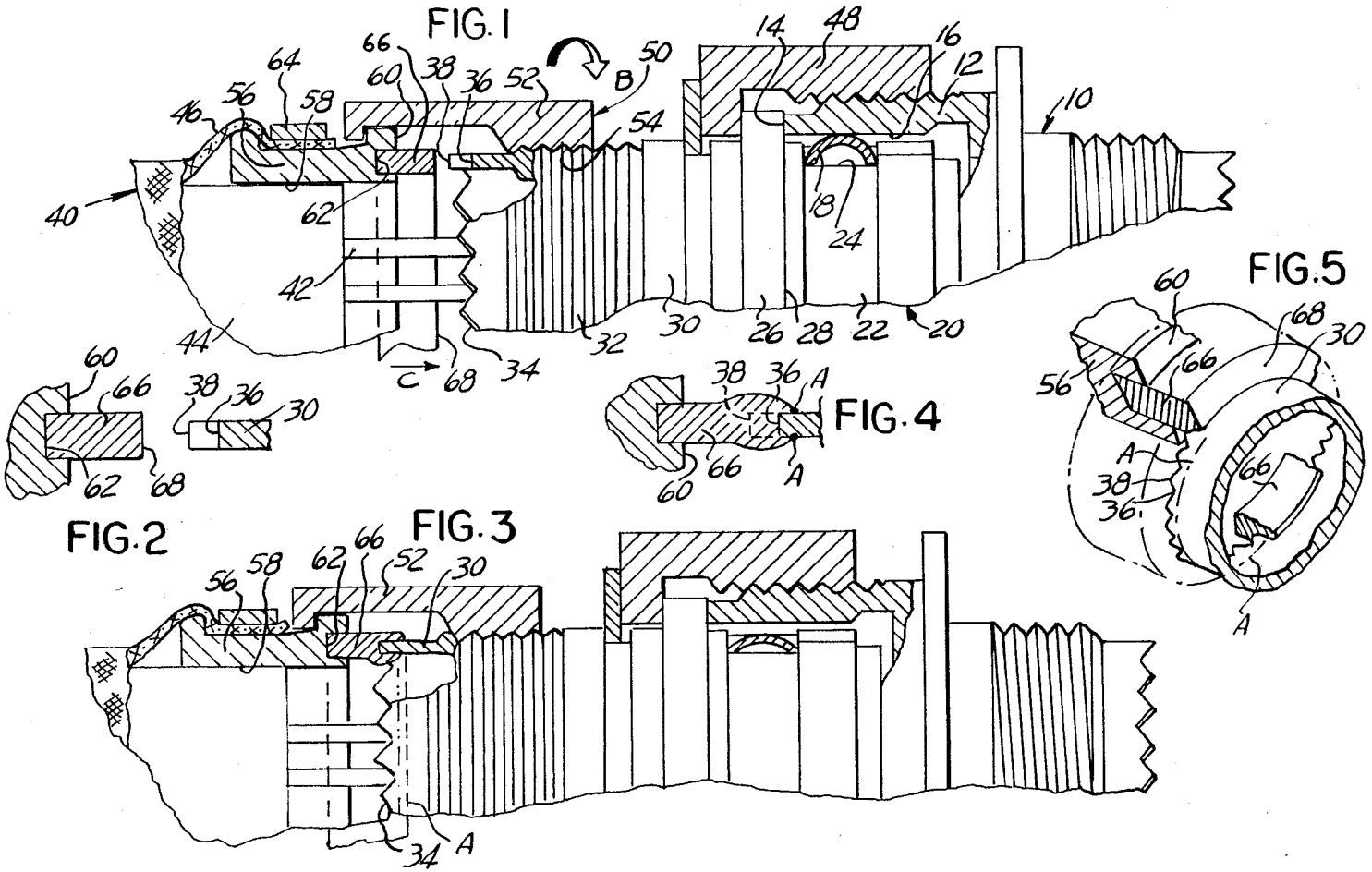
FIG. 1 shows a partial cross-section of an electrical connector assembly having an arrangement providing EMI shielding around the back shell of a plug connector.
FIG. 2 is an enlarged view of the shield arrangement in FIG. 1 being assembled with the connector assembly being omitted for clarity and showing a shielding sleeve being positioned adjacent to locking teeth extending aftwardly from the back shell.

FIG. 3 corresponds to FIG. 1 and shows the EMI shield assembled to the electrical connector assembly.

FIG. 4 corresponds to FIG. 2 and shows the shielding sleeve assembled to the back shell in cross-section.

FIG. 5 shows a perspective view of a portion of the shield assembly.

Referring now to the drawings, and particularly to FIG. 1, an electrical connector assembly prior to complete assembly includes a plug connector member 20 terminating a shielded cable 40, a receptacle member 10, a coupling ring 48 rotatably mounted to the plug connector member for coupling the connector members together, and a grounding strap 18 for shielding the electrical connector assembly from EMI. The cable 40 comprises one or more center conductors 42, a dielectric body 44 surrounding the conductors, and a conductive braid shield 46 surrounding the dielectric. An accessory boot 50 is mounted to plug connector member 20 for supporting the cable 40 thereto. Although not shown, a like shielded cable and boot would be mounted to the receptacle connector.

Plug connector 20 comprises an electrically conductive metallic shell having a forward mating end portion 22 having an outer periphery 24, a conductor receiving back shell or rearward end portion 30, and a radial flange 26 medially of its end portions having an end wall 28 facing forwardly. Although not shown, a dielectric insert supports one or more electrical contacts for termination to respective of the center conductors is mounted in the plug connector member. The back shell 30 includes external thread 32 therearound and a transverse end face 34 comprising a plurality of aftwardly extending V-shaped teeth or serrations having valleys 36 and peaks 38, the teeth being provided to facilitate nonrotational connection thereto of an auxiliary accessory. In some applications, end face 34 could be flat.

Receptacle connector member 10 is compatible for mating to plug connector 20 and will not be described since its details would be understood to one of ordinary skill in the art of assembling electrical connectors. It might be noted that the receptacle includes a generally cylindrical shell 12 of electrically conductive material which, when mated, has a forward end face 14 abutting the end wall 28 of flange 26 and its inner surface 16 compressing the grounding strap 18 radially inward and against the outer periphery 24 of the plug shell. Also, and for the same reasons to be described, the rearward end face includes a plurality of V-shaped serrations.

Accessory boot 50 is of electrically conductive material and includes a generally cylindrical ferrule 56 and a retaining nut 52 rotatably mounted thereto, the ferrule having a bore 58 extending therethrough and being adapted to slidably insert between the braid shield 46 and the dielectric 44, and the retaining nut 52 being provided with internal thread 54 for engaging the external thread 32 on the outer periphery of back shell 30. The ferrule 56 includes an axial end face 60 and an annular groove 62 extending rearwardly therefrom.

To assure complete EMI shielding of the cable where joined to the plug connector, a continuous 360° electrically conductive seal is provided between the cable braid 46, the ferrule 56, and the back shell 30. An end portion of the braid shield is fitted tightly about the ferrule and a clamping ring 64 is crimped radially inward and therearound to both secure the braid to the ferrule and support the cable to the back shell when the accessory boot has been positioned relative to the back shell of the plug connector member, the inward radial crimping forming a continuous 360° electrically conductive seal between the braid and the ferrule.

A cylindrical sleeve 66 of electrically conductive material is mounted in the annular groove 62 such that a forward end face 68 of the sleeve extends longitudinally from the end face 60 and confronts the aft extending teeth 34. Preferably, the sleeve material would be of a soft ductile material for plastically deforming about the V-shaped teeth, the deformation resulting in a forward end portion of the sleeve 66 completely encircling the back shell and extending forwardly of the valleys 36 of the V-shaped electrically conductive teeth to make a continuous metal-to-metal electrically sealing engagement therearound.

Although many malleable and/or ductile materials would be satisfactory for cylindrical sleeve 66, preferred materials would comprise deadsoft copper, deadsoft aluminum, silver, or one of many highly conductive metal or graphite loaded elastomeric materials now available. The term "deadsoft" generally connoting a material which is as soft (i.e., pliable) as possible without going fluid.

As a result of the retaining nut 52 rotating in the direction shown by arrow "B", the accessory boot moves the ferrule 56 and deformable sleeve 66 in the axial direction shown by the arrow associated with "C" towards the back shell to deform the sleeve therearound.

FIG. 2 shows the cylindrical sleeve 66 disposed in the annular groove 62 of the ferrule with a forward sleeve portion being positioned adjacent the peaks 38 and valleys 36 extending aftwardly around the back shell 30.

FIG. 3 shows the cylindrical sleeve 66 plastically deformed about the back shell and the V-shaped teeth. The dotted line designated by the letter "A" shows the forward longitudinal deformation of the end face 68 and of the deformed sleeve relative to the valleys 36 and peaks 38 of the teeth. Although the cylindrical sleeve would preferably be interference fit within the annular groove 62, this is not essential since plastic deformation of the sleeve would cause the sleeve to expand in the groove and thereby assure a complete 360° metal-to-metal seal therewithin.

FIG. 4 shows detail of the deformed relationship of the sleeve 66 with the V-shaped teeth and the location of end face 68 of the sleeve 66 relative to the valleys 36.

FIG. 5 shows a partial section and perspective view of the ferrule 56 having end face 60 and annular groove 62, the cylindrical sleeve 66 extending outwardly of annular groove 62 and having its end face 68 thereof extending longitudinally forward from the valleys 36, and the disposition of the deformed portion of the sleeve around the V-shaped teeth resulting in the teeth being covered and a sealed electrical circuit path being formed around the back shell.

I claim:

1. An electrical connector assembly including means for shielding against electro-magnetic interference, the assembly comprising a shell of electrically conductive material including a generally cylindrical back shell having a transverse end face, a cable having a center conductor encircled by a conductive braid shield and received within and extending rearwardly from said back shell, means including an accessory boot of an electrically conductive material for connecting the cable to the back shell, and means for shielding the center conductor against electro-magnetic interference, said shield means characterized by a continuous 360° electrically conductive seal between the cable braid and said back shell and comprising a ferrule of electrically conductive material being electrically connected to the braid, and a cylindrical sleeve of electrically conductive, plastically deformable material being in electrical circuit relation with the ferrule and the back shell, the sleeve having a forward sleeve portion thereof plastically deformed around and longitudinally forward from the transverse end face of the back shell to provide a continuous electrically conductive seal therearound.

2. The assembly as recited in claim 1 wherein said transverse end face comprises a plurality of aftwardly extending V-shaped teeth, and said sleeve extends longitudinally forward from said ferrule and terminates in a forward end face, said forward end face being plastically deformed by the teeth such that the forward sleeve portion encircles the back shell and extends forwardly therefrom to complete an electrically conductive seal at a back shell location forwardly of the locus of valleys defining the V-shaped teeth.

3. The assembly as recited in claim 2 wherein said ferrule includes an axial end face and an annular groove extends rearwardly therefrom, and said cylindrical sleeve has its rearward sleeve portion interference fit within said annular groove.

4. A method for shielding an electrical connector assembly against electro-magnetic interference, the assembly including a back shell of electrically conductive material, a cable having a center conductor encircled by a conductive braid shield, a ferrule of electrically conductive material in electrical circuit relation to the braid, and means including a rotatably disposed retaining nut for connecting the cable to the back shell, the steps of the method characterized by:

mounting a sleeve of electrically conductive material onto said ferrule so that an electrically conductive seal is formed between said sleeve and said ferrule and so that said sleeve has a forward sleeve portion thereof confronting a transverse end face of the back shell, terminating the cable to the assembly, the termination passing the center conductor into the back shell and the ferrule between the braid shield and the center conductor, and moving said ferrule towards and against the transverse end face of said back shell in an amount sufficient to plastically deform the forward sleeve portion around the back shell and cause the forward sleeve portion thereof, to overlap and completely encircle the back shell in an electrically conductive seal.

5. The method as recited in claim 4 further comprising:

providing an annular groove in an axial wall of the ferrule, mounting the rearward sleeve portion in said annular groove with an interference fit.

* * * * *